US012601351B2

(12) United States Patent
Müller et al.

(10) Patent No.: US 12,601,351 B2
(45) Date of Patent: Apr. 14, 2026

(54) VALVE/PUMP UNIT

(71) Applicant: Vitesco Technologies GmbH, Regensburg (DE)

(72) Inventors: Marius Müller, Darmstadt (DE); Sebastian Brettner, Burglengenfeld (DE); Manuel Dillinger, Kelheim (DE); Markus Feulner, Ensdorf (DE); Gerhard Eser, Hemau (DE); Karl Martin Fritsch, Frankfurt (DE); Christof Heeger, Hessen (DE); Konstantin Bart, Bad Nauheim (DE)

(73) Assignee: VITESCO TECHNOLOGIES GMBH, Regegnsburg (DE)

( * ) Notice: Subject to any disclaimer, the term of this patent is extended or adjusted under 35 U.S.C. 154(b) by 0 days.

(21) Appl. No.: 18/843,872

(22) PCT Filed: Mar. 3, 2023

(86) PCT No.: PCT/EP2023/055452
§ 371 (c)(1),
(2) Date: Sep. 4, 2024

(87) PCT Pub. No.: WO2023/166182
PCT Pub. Date: Sep. 7, 2023

(65) Prior Publication Data

US 2025/0180026 A1 Jun. 5, 2025

(30) Foreign Application Priority Data

Mar. 4, 2022 (DE) ..... 10 2022 202 215.7

(51) Int. Cl.
*F04D 13/06* (2006.01)
*F04D 1/06* (2006.01)
(Continued)

(52) U.S. Cl.
CPC ..... *F04D 13/06* (2013.01); *F04D 1/06* (2013.01); *F04D 13/021* (2013.01); *F04D 15/0016* (2013.01)

(58) Field of Classification Search
CPC ..... F04D 13/06; F04D 13/14; F04D 15/0016; F04D 1/06; F04D 29/426; F04D 13/021;
(Continued)

(56) References Cited

U.S. PATENT DOCUMENTS 3,845,623 A 11/1974 Delancey
5,320,507 A 6/1994 Monnier
(Continued)

FOREIGN PATENT DOCUMENTS

DE 1050288 B 2/1959
DE 1528798 U 9/1969
(Continued)

OTHER PUBLICATIONS

European Search Report dated Apr. 26, 2023 for corresponding European Patent Application No. PCT/EP2023/055452.
(Continued)

*Primary Examiner* — Dominick L Plakkoottam

(57) ABSTRACT

A valve/pump unit is proposed, having an electric motor for driving at least one pump stage, at least one first pump stage drivable by the electric motor for conveying a heat transport medium in a first heat transport medium circuit, an adjustable multiway valve with heat transport medium channels for providing at least two switching positions between the first heat transport medium circuit and a second heat transport medium circuit of a heat transport medium system, and a common housing section for accommodating the electric motor, the multiway valve and the pump stage. The multiway valve is joined to the electric motor in such a way that the multiway valve encloses the electric motor.

15 Claims, 4 Drawing Sheets

(51) Int. Cl.
*F04D 13/02* (2006.01)
*F04D 15/00* (2006.01)

(58) Field of Classification Search
CPC .. F04D 29/5806; F04D 13/0606; F01P 7/165; F01P 2007/146; F01P 2005/105; F01P 5/10; F01P 5/12; F01P 2005/125
See application file for complete search history.

(56) References Cited

U.S. PATENT DOCUMENTS

| | | | | |
|---|---|---|---|---|
| 9,890,686 | B2 * | 2/2018 | Klippert | F01P 5/10 |
| 9,915,192 | B2 * | 3/2018 | Buschur | F02B 39/08 |
| 2006/0216166 | A1 * | 9/2006 | Pawellek | F04D 15/0016 417/371 |
| 2006/0225419 | A1 * | 10/2006 | Prusinski | F02B 39/14 60/605.1 |
| 2014/0050562 | A1 * | 2/2014 | Welte | F04D 15/00 415/55.1 |
| 2020/0340479 | A1 * | 10/2020 | Felix | F04D 29/0416 |
| 2023/0021282 | A1 * | 1/2023 | Dehrmann | F01P 5/12 |
| 2023/0118870 | A1 | 4/2023 | Eser | |
| 2023/0120643 | A1 | 4/2023 | Eser | |

FOREIGN PATENT DOCUMENTS

| | | | | |
|---|---|---|---|---|
| DE | 2107000 | A1 | 8/1972 | |
| DE | 69223374 | | 1/1998 | |
| DE | 19925986 | A1 | 12/2000 | |
| DE | 102006051120 | A1 | 4/2008 | |
| DE | 102012020618 | B3 | 3/2014 | |
| DE | 102018220150 | A1 | 5/2020 | |
| DE | 102019202975 | A1 * | 9/2020 | F04D 15/0022 |
| DE | 102020207028 | A1 | 12/2021 | |
| DE | 102020207925 | A1 | 12/2021 | |
| DE | 102020207927 | A1 | 12/2021 | |
| DE | 102020121163 | A1 | 2/2022 | |
| DE | 102022202216 | A1 | 9/2023 | |
| DE | 102022202217 | A1 | 9/2023 | |
| EP | 2163764 | A2 | 3/2010 | |
| EP | 2884107 | A2 | 6/2015 | |
| EP | 3156662 | A1 | 4/2017 | |
| EP | 3376051 | A1 | 9/2018 | |
| JP | 2011052632 | A | 3/2011 | |
| JP | 2018197526 | A | 12/2018 | |
| WO | 2004088143 | A1 | 10/2004 | |
| WO | 2006122906 | A1 | 11/2006 | |
| WO | 2015070955 | A1 | 5/2015 | |

OTHER PUBLICATIONS

German Search Report dated to Oct. 2022 for corresponding German Patent Application No. 10 2022 202 215.7.

* cited by examiner

VALVE/PUMP UNIT

CROSS-REFERENCE TO RELATED APPLICATIONS

This application claims priority to PCT Application PCT/EP2023/055452, filed Mar. 3, 2023, which claims priority to German Patent Application No. DE 10 2022 202 215.7, filed Mar. 4, 2022. The disclosures of the above applications are incorporated herein by reference.

FIELD OF THE INVENTION

The present invention relates to a valve/pump unit for a heat transport medium system of a vehicle, a heat transport medium system having such a valve/pump unit and a vehicle having such a valve/pump unit.

SUMMARY OF THE INVENTION

It is an object of the present invention to improve a heat transport medium system of a vehicle. A further object is to simplify such a heat transport medium system.

A valve/pump unit is proposed. This valve/pump unit has:

an electric motor for driving at least one pump stage, at least one first pump stage drivable by the electric motor for carrying a heat transport medium in a first heat transport medium circuit, an adjustable multiway valve with heat transport medium channels for providing at least two switching positions between the first heat transport medium circuit and a second heat transport medium circuit of a heat transport medium system, and a common housing section for accommodating the electric motor, the multiway valve and the pump stage.

The multiway valve is joined to the electric motor in such a way that the multiway valve encloses the electric motor, for example encloses it annularly.

At least one internal contour of the multiway valve that encloses the electric motor may be designed to be at least substantially circular.

Additionally or alternatively, an external contour of the multiway valve may be designed to be at least substantially circular.

The multiway valve may thus have an at least substantially annular shape and surround the electric motor annularly or at least substantially annularly.

The multiway valve is designed to be circumferentially closed. Such a closed circumferential structure offers increased structural rigidity as compared with an open structure.

The proposed valve/pump unit represents an integration of multiple components of such an aforementioned heat transport medium circuit in one unit or one core module.

This is also associated with a reduction in the components required to operate such a heat transport medium circuit. Since such components are saved, such a heat transport medium circuit or heat transport medium system having such a heat transport medium circuit is simplified.

By using such a highly integrated valve/pump unit (in the sense of a core module), weight, installation space and costs may also be saved.

According to one embodiment, the valve/pump unit additionally has a reduction gearbox for adjusting the multiway valve. This reduction gearbox is provided and arranged inside or outside the common housing section.

According to a further embodiment, the reduction gearbox provided and arranged outside the common housing section is accommodated by the common housing section—at least indirectly.

In the case of the reduction gearbox provided and arranged inside the common housing section, the reduction gearbox is drivable by the aforementioned, single electric motor by which the at least one pump stage is driven.

Alternatively, in the case of the reduction gearbox provided and arranged outside the common housing section, the reduction gearbox is drivable by a further, separate—or second—electric motor outside the common housing section.

In the first case, with only one single electric motor—in a pumping operation in a first direction of rotation of the electric motor, the reduction gearbox is uncoupled from the electric motor via a freewheel. And the reduction gearbox is operable in a second direction of rotation of the electric motor, opposite to the pump operation, to adjust the multiway valve.

According to a further embodiment, the multiway valve has at least one (valve) section having individual channel sections that is fixed relative to the common housing section, and at least one (valve) section having individual channel sections that is pivotable relative to the common housing section, via which the aforesaid switching positions of the multiway valve are adjusted between the first heat transport medium circuit and the second heat transport medium circuit of the heat transport medium system.

The heat transport medium channels of the multiway valve or its individual (valve) sections forming the heat transport medium channels extend between the common housing section and the electric motor—that drive the at least one pump stage.

According to one embodiment, the multiway valve is designed in the form of a 4/2-way valve. This permits the previously described multi-part nature of the multiway valve also to be depicted by combinations of valves by a corresponding configuration of individual valve sections—with associated channel sections—for example a combination of a 4/2-way valve with a 3/2-way valve.

According to a further embodiment, the valve/pump unit additionally has a second pump stage for conveying the heat transport medium in the second heat transport medium circuit. It is proposed to accommodate this second pump stage—at least indirectly—by the common housing section as well in order to increase the integration density of the valve/pump unit.

According to a further embodiment, a clutch which connects the electric motor and the second pump stage releasably to each other is arranged between the electric motor by which the two pump stages is driven and the second pump stage. The clutch is designed in the form of an opening clutch, for example a centrifugal force clutch, via which the second pump stage is uncoupled or released. Alternatively, this clutch may also be designed as a closing clutch, for example in the form of a centrifugal force clutch, via which the second pump stage is coupled up.

Such a clutch makes it possible as necessary to operate only the first heat transport medium circuit or to convey the heat transport medium only in the first heat transport medium circuit, for example for the fast loading of a battery of the first heat transport medium circuit.

Alternatively, in a further embodiment, such a clutch is omitted, so that the two pump stages are connected permanently to each other.

According to a further embodiment, the electric motor by which the at least one pump stage is driven and/or the electric motor by which the reduction gearbox provided outside the common housing section is driven is/are designed as a dry-running motor.

According to a further embodiment, the first pump stage (PS1) and/or the second pump stage (PS2) are designed in the form of a radial pump stage.

However, the pump stages may also be designed as flow pump (stages) or as displacement pump (stages).

Also proposed is a heat transport medium system having a valve/pump unit of the previously described type for a vehicle, having a first heat transport medium circuit and a second heat transport medium circuit, wherein the valve/pump unit is provided and arranged between the two circuits.

Also proposed is a vehicle having a valve/pump unit of the previously described type or a heat transport medium system of the previously described type.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention will be explained in detail below with reference to the illustrations in the figures. Further developments of the invention may be found in the following description of preferred embodiments. In this respect.

DETAILED DESCRIPTION OF THE PREFERRED EMBODIMENTS

The following description of the preferred embodiment(s) is merely exemplary in nature and is in no way intended to limit the invention, its application, or uses.

Figure 1:
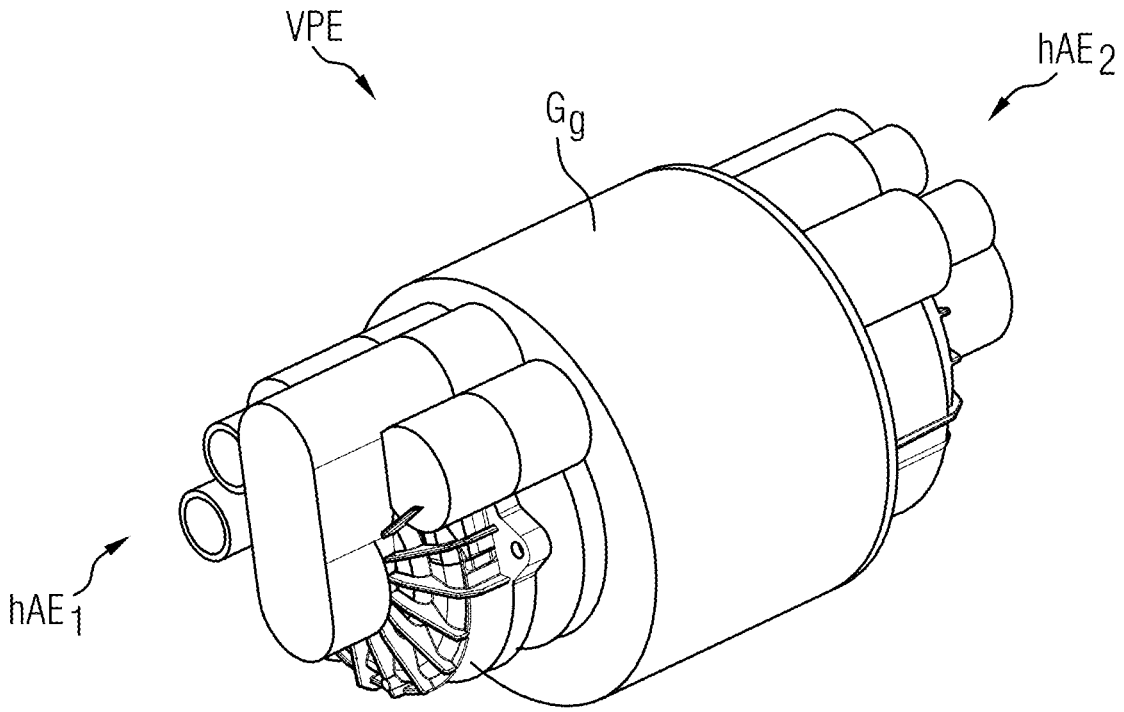
FIG. 1 shows a perspective view of a valve/pump unit.

FIG. 1 illustrates a proposed substantially cylindrical valve/pump unit VPE, which is attached or connected hydraulically via a first connection end $hAE_1$ to a first heat transport medium circuit (or cooling circuit) and hydraulically via a second connection end $hAE_2$ to a second heat transport medium circuit (or cooling circuit) of a heat transport medium system (or thermal management system) of a vehicle.

This valve/pump unit VPE provides two selective switching positions of a multiway valve MWV in the shape of a 4/2-way valve between the first circuit and the second circuit.

Figure 2:
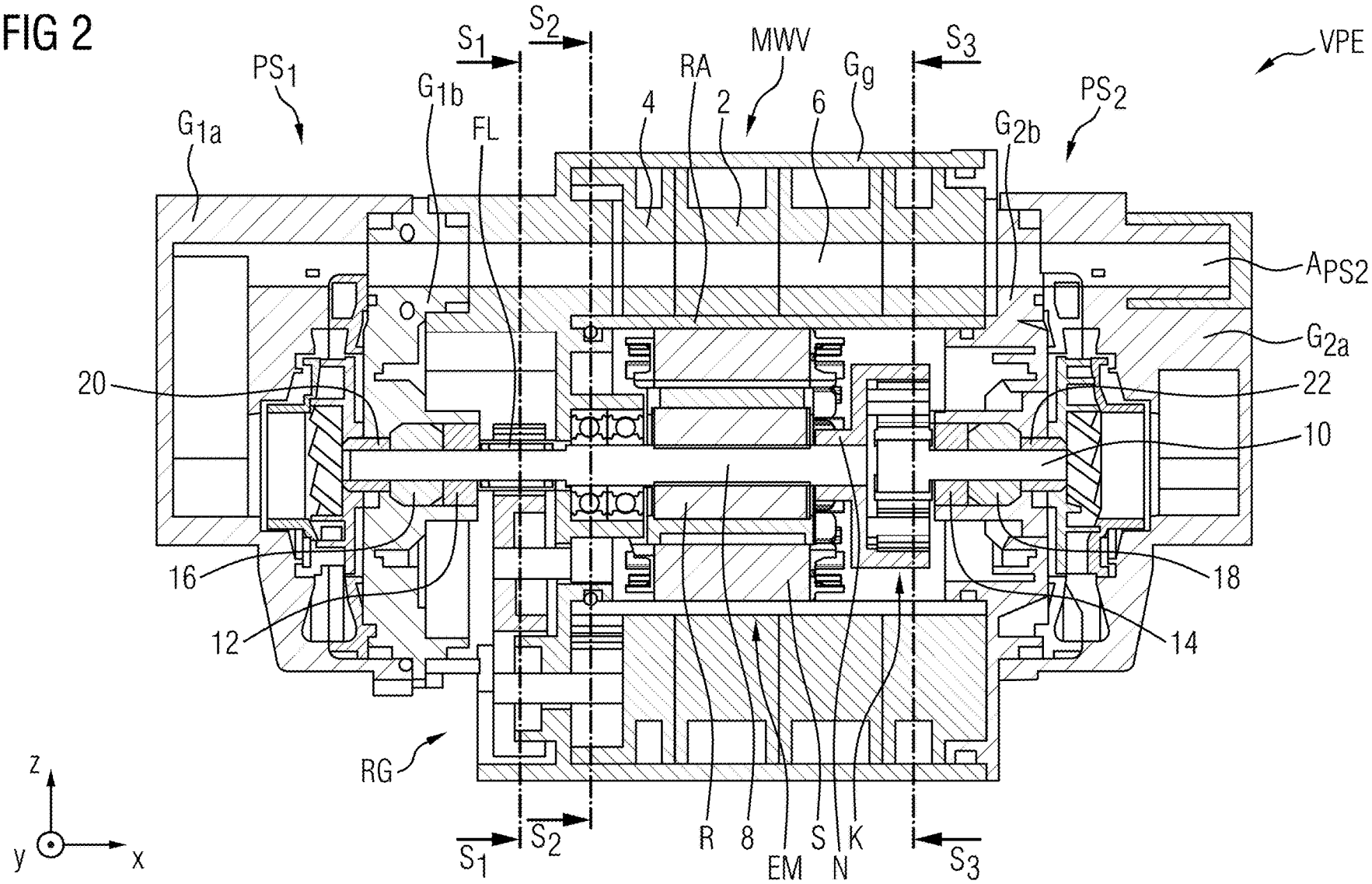
FIG. 2 shows the valve/pump unit shown in FIG. 1 in a sectional view.
Figure 3:
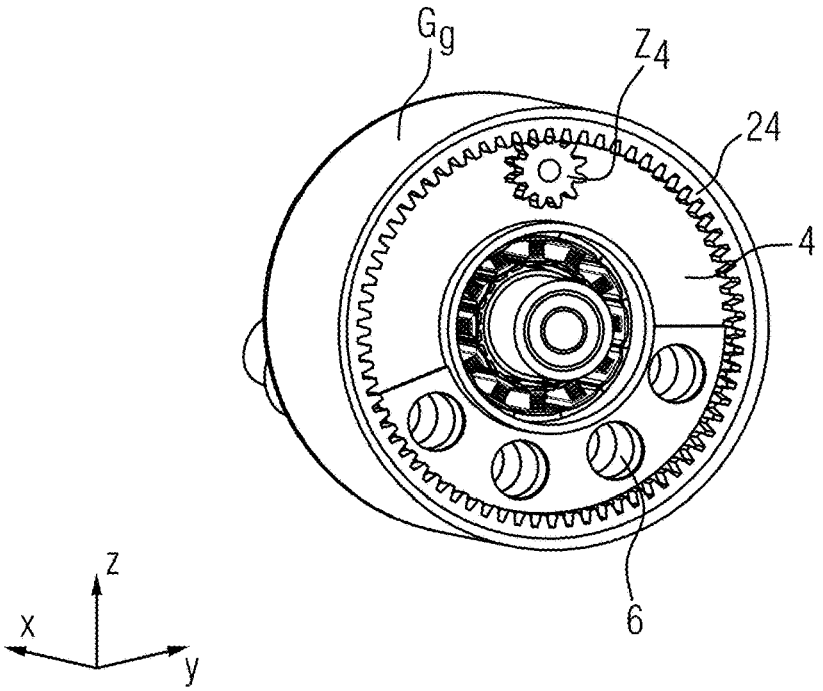
FIG. 3 shows a perspective sectional view with respect to the section line $S_1$-$S_1$ in FIG. 2.

FIG. 2 illustrates which components of the first and second circuit are integrated into this valve/pump unit VPE by a common housing section Gg. The housing section Gg thus has a centrally supporting and integrating function.

A single electric motor or E-motor EM designed as an internal rotor and a dry-running motor is joined to the multiway valve MWV in such a way that the multiway valve MWV encloses the E-motor EM annularly—for example completely or in a circumferentially closed manner—within the common housing section Gg. The E-motor EM forms a central or centrally driving component of the valve/pump unit VPE.

The stator S of the E-motor EM is arranged within a tubular section RA or an at least tube-like section RA, wherein this tubular section RA is sealed off adequately with respect to its periphery at both ends in a respectively associated area and thus forms a dry space for the stator S and the rotor R of the electric motor EM within the tubular section RA.

The multiway valve MWV joined to the tubular section RA has at least one section 2 that is fixed relative to the housing section Gg and at least one section 4 that is pivotable relative to the housing section Gg in a first or a second direction of rotation of the E-motor EM. Heat transport medium channels 6 (or liquid channels 6) in the multiway valve MWV extend between the housing section Gg and the E-motor EM.

The outer circumferential side of the individual sections 2, 4 of the multiway valve MWV is cut away in some sections to save weight and, in conjunction with the common housing section Gg, form individual cavities, in which conveyed fluid or conveyed liquid may collect (FIG. 2).

The valve/pump unit VPE has a first pump stage $PS_1$, for example in the form of a flow pump stage, for example in the form of a radial pump stage, and a second pump stage $PS_2$, for example in the form of a flow pump stage, for example in the form of a radial pump stage, which are each drivable via a drive shaft 8 of the E-motor EM.

The two pump stages $PS_1$, $PS_2$ each have at least a first and second housing section $G_{1a}$, $G_{1b}$ and $G_{2a}$, $G_{2b}$. The two housing sections $G_{1b}$, $G_{2b}$—which as such face the common housing section Gg—are joined to the housing section Gg or accommodated by the latter.

A three-stage reduction gearbox RG for the selective adjustment of the multiway valve MWV is, for example, provided and arranged between the pump stage $PS_1$ and the E-motor EM. The sectional illustration in FIG. 4 (corresponding to a section through the section line or plane $S_1$-$S_1$ in (FIG. 2) illustrates the gear wheels $Z_1$, $Z_2$, $Z_3$ of the first and second gearbox stage, and the sectional illustration in FIG. 2 (corresponding to a section through the section line or plane $S_2$-$S_2$ in FIG. 2) illustrates the gear wheel $Z_4$ of the fourth gearbox stage. The gear wheel $Z_4$ meshes with internal toothing 24 formed on the pivotable section 4 of the multiway valve MWV, so that the section 4 functions with the effect of a ring gear, which is pivoted selectively via the gear wheel $Z_4$. In the present embodiment of the reduction gearbox RG, the section 4 pivots in a direction of rotation of the E-motor EM which corresponds to the pump operation of the E-motor EM. In an alternative embodiment of the reduction gearbox RG, however, the section 4 also pivots in a direction of rotation of the E-motor EM which is opposite to that in pump operation.

Figure 4:
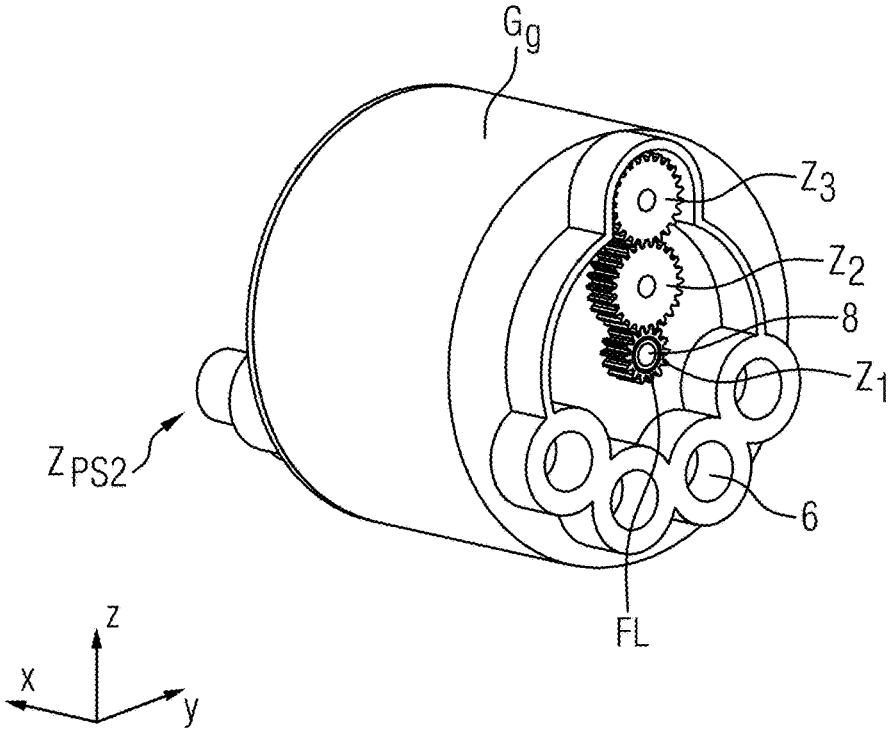
FIG. 4 shows a perspective sectional view with respect to the section line $S_2$-$S_2$ in FIG. 2.

Provided and arranged between the drive shaft 8 and the gear wheel $Z_1$ is a freewheel FL—for example in the form of a clamping roller freewheel—which transmits torque to the reduction gearbox RG only in a direction of rotation that is opposite to the pump operation of the electric motor EM, and thus permits the selective adjustment of the multiway valve MWV into at least two switching positions (FIG. 4, FIG. 2). Alternatively, the freewheel FL could also be arranged at a different point of the reduction gearbox RG.

In the direction of the pump stage $PS_1$, the drive shaft 8 extends through a rolling-contact bearing arrangement—in the form of an overhung bearing—to accommodate the drive shaft 8 in the housing section Gg, the freewheel FL, a seal 12, a sliding bearing 16 and as far as into a metallic bush 20, e.g. a brass bush, on which the impeller of the pump stage $PS_1$ is seated.

In the direction of the pump stage $PS_2$, on the other hand, the drive shaft 8 extends into a hub section N of a centrifugal force clutch K, via which the pump stage $PS_2$ is attached to the E-motor EM. On the drive side, a drive shaft 10 extends from this centrifugal clutch K through a seal 14, a sliding bearing 18 and as far as into a metallic bush 22, e.g. a brass bush, on which the impeller of the pump stage $PS_2$ is seated. The centrifugal force clutch K is designed in the sense of an opening clutch which, starting from a specific rotational speed of the drive shaft 8, opens and as a result releases the operative connection of the E-motor EM to the pump stage $PS_2$. Thus, in pump operation, if necessary in a corresponding operating mode of the E-motor EM, the pump stage $PS_2$ is uncoupled or released by the centrifugal force clutch K.

The centrifugal force clutch K is arranged within the tubular section RA between the E-motor EM and the pump stage $PS_2$. The two seals 12, 14 contribute to keeping the reduction gearbox RG, the centrifugal force coupling K and the E-motor EM dry.

Figure 5:
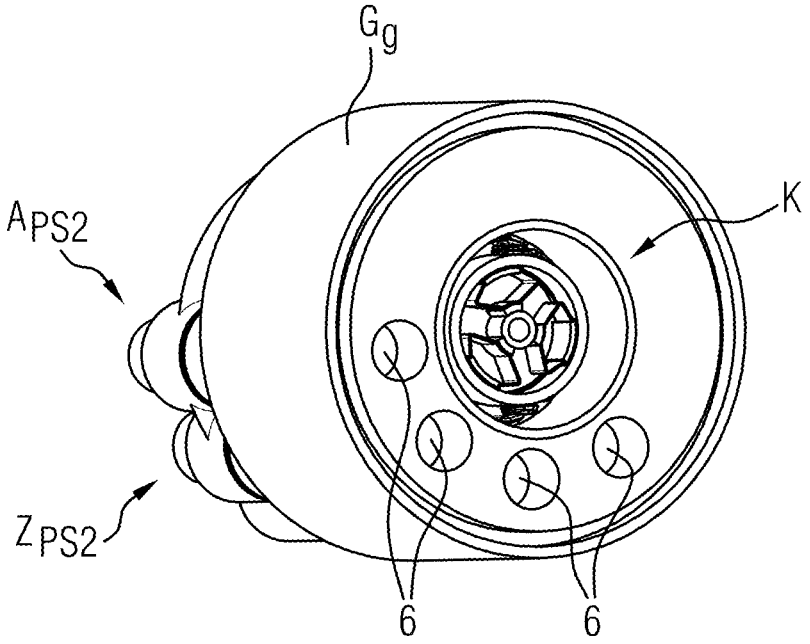
FIG. 5 shows a perspective sectional view with respect to the section line $S_3$-$S_3$ in FIG. 2.
Figure 6:
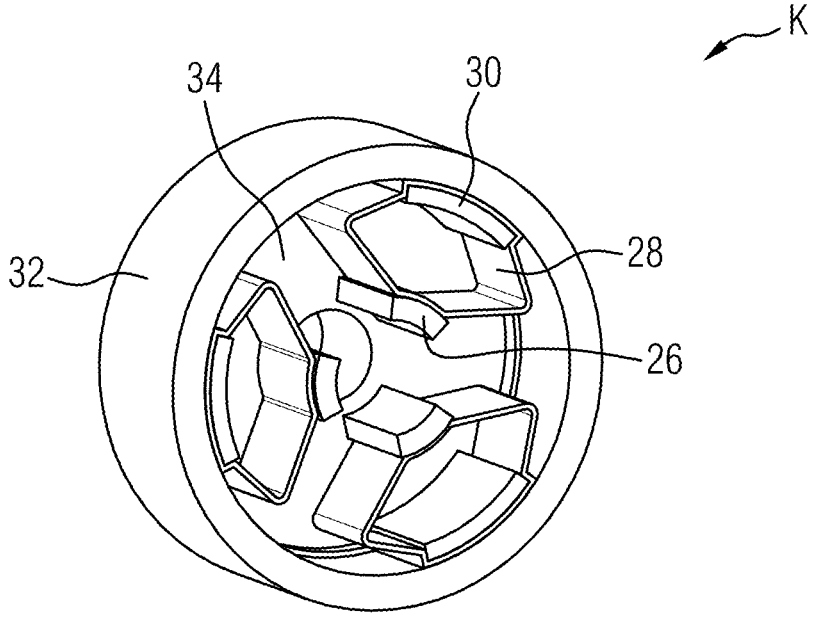
FIG. 6 shows an enlarged view of the clutch shown in FIG. 5.

The sectional illustrations in FIG. 5, 6 (corresponding to a section through the section line or plane $S_3$-$S_3$ in FIG. 2) illustrate the aforesaid centrifugal force clutch K, which includes a closed revolving disk section 34 molded on the hub section N and a closed revolving ring section 32 molded on the disk section 34. Molded on the front face of the disk section 34 in addition are three arcuate claws 30 spaced apart uniformly from one another in the circumferential direction of the centrifugal force clutch K to accommodate a closed revolving spring element 28.

With respect to their extent in the circumferential direction of the centrifugal force clutch K, these claws 30 are spaced apart radially relative to the ring section 32 in such a way that, with the ring section 32, they form an arcuate gap, into which an associated spring element 28 is inserted.

Radially on the inner side, each of these spring elements 28 carries what is known as a clutch lining element 26, which is molded so as to correspond or be complementary to the section of the driveshaft 10 illustrated in FIG. 5. This clutch lining element 26 may be an element composed of a suitable frictional and bonding element or else an element including such a frictional and bonding element. The clutch lining element 26 may also be formed from an elastomer or else include such an elastomer. The clutch lining element 26 forms a form and force fit with the aforesaid output shaft section (FIG. 5).

In a further embodiment—not illustrated here—it is proposed to design the clutch in the form of a closing centrifugal force clutch.

The E-motor EM of the valve/pump unit VPE is operable in two directions of rotation:

a) in a first direction of rotation in the aforesaid pump operation, and
b) to drive the reduction gearbox RG in a second direction of rotation, opposite to the pump operation, to adjust the multi-way valve MWV.

In pump operation, the reduction gearbox RG is uncoupled from the E-motor EM via the freewheel FL.

The adjustment of the pivotable or rotatably adjustable multiway valve MWV is carried out step-by-step or in a staggered manner or else continuously from one switching position to another switching position of the multiway valve MWV.

In FIG. 2, one of two switching positions of the 4/2 multiway valve MWV may also be seen, in which an outlet or outlet connection $A_{PS2}$ of the pump stage $PS_2$ or of the second circuit has a fluid connection or flow connection to the pump stage $PS_1$ via an associated channel 6.

FIG. 2 illustrates a series connection of the two aforementioned circuits—i.e. of the first and second heat transport medium circuit—in which the outlet $A_{PS2}$ has a fluid connection to a feed $Z_{PS1}$—not illustrated in FIG. 2—of the pump stage $PS_1$ or of the first circuit. The same is also true of an outlet or outlet connection $A_{PS1}$—not illustrated in FIG. 2—of the pump stage $PS_1$ or of the first circuit, which has a fluid connection to a feed $Z_{PS2}$—not illustrated in FIG. 2—of the pump stage $PS_2$ or of the second circuit.

By contrast, in a parallel connection—not illustrated here—of the two aforementioned circuits, on the one hand the outlet $A_{PS1}$ has a fluid connection to the feed $Z_{PS1}$ and on the other hand the outlet $A_{PS2}$ has a fluid connection to the feed $Z_{PS2}$, specifically each via an associated channel 6 in the multiway valve MWV. This means that conveyed fluid or conveyed liquid is redirected in the multiway valve MWV.

FIG. 5 illustrates the outlet $A_{PS2}$ and the feed $Z_{PS2}$ of the second circuit.

In addition, between this series and parallel connection of the two circuits, various mixed positions of the section 4 or the multiway valve MWV are possible. For this purpose, the multiway valve MWV has an arrangement of appropriately formed channels 6—not illustrated here—which bring about or effect such mixed states within the multiway valve MWV.

In a further embodiment—not illustrated here—further freewheels are also provided, specifically on the pump stage $PS_1$ between the metallic bush 20 and the driveshaft 8 and/or on the pump stage $PS_2$ between the metallic bush 22 and the drive shaft 10. Therefore, the conveyed fluid is not braked in the direction of rotation of the E-motor EM that is opposed to pump operation but, instead, may continue to flow because of its mass moment of inertia.

In a further embodiment—not illustrated here—the reduction gearbox is provided and arranged outside the common housing section and is driven by a further, separate electric motor—outside the common housing section.

Because of the proposed valve/pump unit, the aforementioned heat transport medium circuits or such a heat transport medium system having such heat transport medium circuits are greatly simplified.

Individual, previously necessary, components may be saved and, concomitantly, also weight, overall space and costs.

Although exemplary embodiments are explained in the preceding description, it should be pointed out that a large number of modifications is possible. It should be noted, furthermore, that the exemplary embodiments are merely examples which are in no way intended to limit the scope of protection, the applications, and the structure. Instead, the above description gives a person skilled in the art a guideline for the implementation of at least one exemplary embodiment, it being possible to make various changes, especially with regard to the function and arrangement of the component parts described, without departing from the scope of protection as emerges from the combinations of features that are equivalent thereto.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A valve/pump unit comprising:
an electric motor;
a reduction gearbox;
at least one pump stage, further comprising:
at least one first pump stage drivable by the electric motor for conveying a heat transport medium in a first heat transport medium circuit;
an adjustable multiway valve, further comprising:
a plurality of heat transport medium channels for providing at least two switching positions between the first heat transport medium circuit and a second heat transport medium circuit of a heat transport medium system; and
a common housing section for accommodating the electric motor, the multiway valve and the at least one first pump stage;
wherein the multiway valve is joined to the electric motor in such a way that the multiway valve encloses the electric motor, and the reduction gearbox adjusts the multiway valve.

2. The valve/pump unit of claim 1, wherein the reduction gearbox is provided inside the common housing section and is drivable by the electric motor.

3. The valve/pump unit of claim 1, further comprising:
a freewheel connected to the electric motor, and selectively coupled to the reduction gearbox;
wherein in pump operation, in a first direction of rotation of the electric motor, the reduction gearbox is uncoupled from the electric motor via the freewheel, and in a second direction of rotation of the electric motor, opposite to the pump operation, the reduction gearbox is operable to adjust the multiway valve.

4. The valve/pump unit of claim 1, further comprising:
a second electric motor outside the common housing section;
wherein the reduction gearbox provided outside the common housing section is drivable by the second electric motor.

5. The valve/pump unit of claim 4, wherein the second electric motor is a dry-running motor.

6. The valve/pump unit of claim 1, wherein the electric motor is a dry-running motor.

7. The valve/pump unit of claim 1, wherein the reduction gearbox is outside the common housing section.

8. The valve/pump unit of claim 1, the adjustable multiway valve further comprising:
at least one section that is fixed in relation to the common housing section; and
at least one section that is pivotable with respect to the common housing section.

9. The valve/pump unit of claim 1, the plurality of heat transport medium channels further comprising individual channel sections arranged between the common housing section and the electric motor.

10. The valve/pump unit of claim 1, wherein the first pump stage is a radial pump stage.

11. A valve/pump unit comprising:
an electric motor;
an adjustable multiway valve, further comprising:
a plurality of heat transport medium channels for providing at least two switching positions between a first heat transport medium circuit and a second heat transport medium circuit of a heat transport medium system;
at least one pump stage, further comprising:
at least one first pump stage drivable by the electric motor for conveying a heat transport medium in the first heat transport medium circuit;
a second pump stage for conveying the heat transport medium in the second heat transport medium circuit;
a clutch arranged between the electric motor and the second pump stage, the clutch releasably connects the electric motor and the second pump stage to each other;
a common housing section for accommodating the electric motor, the multiway valve and the at least one first pump stage;
wherein the multiway valve is joined to the electric motor in such a way that the multiway valve encloses the electric motor.

12. The valve/pump unit of claim 11, wherein the second pump stage is a radial pump stage.

13. The valve/pump unit of claim 11, wherein the second pump stage is accommodated by the common housing section.

14. The valve/pump unit of claim 11, wherein the clutch is an opening or closing centrifugal force clutch.

15. A heat transport medium system for a vehicle, comprising:
a first heat transport medium circuit;
a second heat transport medium circuit;
a valve/pump unit between the first heat transport medium circuit and the second heat transport medium circuit, the valve/pump unit further comprising:
an electric motor;
at least one pump stage, further comprising:
at least one first pump stage drivable by the electric motor for conveying a heat transport medium in the first heat transport medium circuit;
an adjustable multiway valve, further comprising:
a plurality of heat transport medium channels for providing at least two switching positions between the first heat transport medium circuit and the second heat transport medium circuit of the heat transport medium system;
at least one section that is fixed in relation to the common housing section;
at least one section that is pivotable with respect to the common housing section; and
a common housing section for accommodating the electric motor, the multiway valve and the at least one first pump stage;
wherein the multiway valve is joined to the electric motor in such a way that the multiway valve encloses the electric motor.

* * * * *